US010129620B2

(12) United States Patent
Boesen

(10) Patent No.: US 10,129,620 B2
(45) Date of Patent: Nov. 13, 2018

(54) MULTILAYER APPROACH TO HYDROPHOBIC AND OLEOPHOBIC SYSTEM AND METHOD

(71) Applicant: BRAGI GmbH, München (DE)

(72) Inventor: Peter Vincent Boesen, München (DE)

( * ) Notice: Subject to any disclaimer, the term of this patent is extended or adjusted under 35 U.S.C. 154(b) by 6 days.

(21) Appl. No.: 15/414,013

(22) Filed: Jan. 24, 2017

(65) Prior Publication Data

US 2017/0214987 A1 Jul. 27, 2017

Related U.S. Application Data

(60) Provisional application No. 62/286,700, filed on Jan. 25, 2016.

(51) Int. Cl.
*H04R 1/02* (2006.01)
*H04R 1/10* (2006.01)

(52) U.S. Cl.
CPC ..... *H04R 1/023* (2013.01); *H04R 1/1016* (2013.01)

(58) Field of Classification Search
CPC ..... H04R 25/60; H04R 25/65; H04R 25/00; H04R 2460/17; H04R 2225/023; H04R 2225/025; H04R 1/105; H04R 2225/021; H04R 2225/63; H04R 2460/13
USPC ..... 381/322, 324–325, 328, 330, 380–381
See application file for complete search history.

(56) References Cited

U.S. PATENT DOCUMENTS 3,934,100 A 1/1976 Harada
4,150,262 A 4/1979 Ono
4,334,315 A 6/1982 Ono et al.
4,375,016 A 2/1983 Harada
4,588,867 A 5/1986 Konomi
4,607,720 A * 8/1986 Hardt ..... H04R 25/652 181/135
4,654,883 A 3/1987 Iwata
4,682,180 A 7/1987 Gans
4,791,673 A 12/1988 Schreiber
(Continued)

FOREIGN PATENT DOCUMENTS

EP 1017252 A2 7/2000
EP 2903186 A1 8/2015
(Continued)

OTHER PUBLICATIONS

Announcing the $3,333,333 Stretch Goal (Feb. 24, 2014).
(Continued)

*Primary Examiner* — Suhan Ni
(74) *Attorney, Agent, or Firm* — Goodhue, Coleman & Owens, P.C.

(57) ABSTRACT

An earpiece may include an earpiece housing, an electronics package associated with the earpiece housing, a hydrophobic barrier on the earpiece, and an oleophobic barrier on the earpiece. The hydrophobic barrier may be applied directly to the electronics package. The oleophobic barrier may be distal to the electronics package. The oleophobic barrier may be an oleophobic nano-coating applied to a mesh or screen. The hydrophobic barrier may be distal to the electronics package. The oleophobic barrier may be distal to the hydrophobic barrier. The hydrophobic barrier may be a nano-coating applied directly to a mesh or screen. The oleophobic barrier may be a nano-coating applied directly to a mesh or screen.

15 Claims, 5 Drawing Sheets

(56) References Cited

U.S. PATENT DOCUMENTS

| | | | |
|---|---|---|---|
| 4,865,044 | A | 9/1989 | Wallace et al. |
| 5,191,602 | A | 3/1993 | Regen et al. |
| 5,201,007 | A | 4/1993 | Ward et al. |
| 5,280,524 | A | 1/1994 | Norris |
| 5,295,193 | A | 3/1994 | Ono |
| 5,298,692 | A | 3/1994 | Ikeda et al. |
| 5,343,532 | A | 8/1994 | Shugart |
| 5,363,444 | A | 11/1994 | Norris |
| 5,497,339 | A | 3/1996 | Bernard |
| 5,606,621 | A | 2/1997 | Reiter et al. |
| 5,613,222 | A | 3/1997 | Guenther |
| 5,692,059 | A | 11/1997 | Kruger |
| 5,721,783 | A | 2/1998 | Anderson |
| 5,749,072 | A | 5/1998 | Mazurkiewicz et al. |
| 5,771,438 | A | 6/1998 | Palermo et al. |
| 5,802,167 | A | 9/1998 | Hong |
| 5,929,774 | A | 7/1999 | Charlton |
| 5,933,506 | A | 8/1999 | Aoki et al. |
| 5,949,896 | A | 9/1999 | Nageno et al. |
| 5,987,146 | A | 11/1999 | Pluvinage et al. |
| 6,021,207 | A | 2/2000 | Puthuff et al. |
| 6,054,989 | A | 4/2000 | Robertson et al. |
| 6,081,724 | A | 6/2000 | Wilson |
| 6,094,492 | A | 7/2000 | Boesen |
| 6,111,569 | A | 8/2000 | Brusky et al. |
| 6,112,103 | A | 8/2000 | Puthuff |
| 6,157,727 | A | 12/2000 | Rueda |
| 6,167,039 | A | 12/2000 | Karlsson et al. |
| 6,181,801 | B1 | 1/2001 | Puthuff et al. |
| 6,208,372 | B1 | 3/2001 | Barraclough |
| 6,275,789 | B1 | 8/2001 | Moser et al. |
| 6,339,754 | B1 | 1/2002 | Flanagan et al. |
| 6,408,081 | B1 | 6/2002 | Boesen |
| D464,039 | S | 10/2002 | Boesen |
| 6,470,893 | B1 | 10/2002 | Boesen |
| D468,299 | S | 1/2003 | Boesen |
| D468,300 | S | 1/2003 | Boesen |
| 6,542,721 | B2 | 4/2003 | Boesen |
| 6,560,468 | B1 | 5/2003 | Boesen |
| 6,654,721 | B2 | 11/2003 | Handelman |
| 6,664,713 | B2 | 12/2003 | Boesen |
| 6,694,180 | B1 | 2/2004 | Boesen |
| 6,718,043 | B1 | 4/2004 | Boesen |
| 6,738,485 | B1 | 5/2004 | Boesen |
| 6,748,095 | B1 | 6/2004 | Goss |
| 6,754,358 | B1 | 6/2004 | Boesen et al. |
| 6,784,873 | B1 | 8/2004 | Boesen et al. |
| 6,823,195 | B1 | 11/2004 | Boesen |
| 6,852,084 | B1 | 2/2005 | Boesen |
| 6,879,698 | B2 | 4/2005 | Boesen |
| 6,892,082 | B2 | 5/2005 | Boesen |
| 6,920,229 | B2 | 7/2005 | Boesen |
| 6,952,483 | B2 | 10/2005 | Boesen et al. |
| 6,987,986 | B2 | 1/2006 | Boesen |
| 7,136,282 | B1 | 11/2006 | Rebeske |
| 7,203,331 | B2 | 4/2007 | Boesen |
| 7,209,569 | B2 | 4/2007 | Boesen |
| 7,215,790 | B2 | 5/2007 | Boesen et al. |
| 7,463,902 | B2 | 12/2008 | Boesen |
| 7,508,411 | B2 | 3/2009 | Boesen |
| 7,983,628 | B2 | 7/2011 | Boesen |
| 8,140,357 | B1 | 3/2012 | Boesen |
| 2001/0005197 | A1 | 6/2001 | Mishra et al. |
| 2001/0027121 | A1 | 10/2001 | Boesen |
| 2001/0056350 | A1 | 12/2001 | Calderone et al. |
| 2002/0002413 | A1 | 1/2002 | Tokue |
| 2002/0007510 | A1 | 1/2002 | Mann |
| 2002/0010590 | A1 | 1/2002 | Lee |
| 2002/0030637 | A1 | 3/2002 | Mann |
| 2002/0046035 | A1 | 4/2002 | Kitahara et al. |
| 2002/0057810 | A1 | 5/2002 | Boesen |
| 2002/0076073 | A1 | 6/2002 | Taenzer et al. |
| 2002/0118852 | A1 | 8/2002 | Boesen |
| 2003/0065504 | A1 | 4/2003 | Kraemer et al. |
| 2003/0100331 | A1 | 5/2003 | Dress et al. |
| 2003/0104806 | A1 | 6/2003 | Ruef et al. |
| 2003/0115068 | A1 | 6/2003 | Boesen |
| 2003/0125096 | A1 | 7/2003 | Boesen |
| 2003/0218064 | A1 | 11/2003 | Conner et al. |
| 2004/0070564 | A1 | 4/2004 | Dawson et al. |
| 2004/0160511 | A1 | 8/2004 | Boesen |
| 2005/0043056 | A1 | 2/2005 | Boesen |
| 2005/0125320 | A1 | 6/2005 | Boesen |
| 2005/0148883 | A1 | 7/2005 | Boesen |
| 2005/0165663 | A1 | 7/2005 | Razumov |
| 2005/0196009 | A1 | 9/2005 | Boesen |
| 2005/0251455 | A1 | 11/2005 | Boesen |
| 2005/0266876 | A1 | 12/2005 | Boesen |
| 2006/0029246 | A1 | 2/2006 | Boesen |
| 2006/0074671 | A1 | 4/2006 | Farmaner et al. |
| 2006/0074808 | A1 | 4/2006 | Boesen |
| 2008/0254780 | A1 | 10/2008 | Kuhl et al. |
| 2009/0017881 | A1 | 1/2009 | Madrigal |
| 2009/0154747 | A1* | 6/2009 | Vestergaard ..... H04R 25/654 381/325 |
| 2010/0320961 | A1 | 12/2010 | Castillo et al. |
| 2011/0027665 | A1* | 2/2011 | Burchardt ..... B60L 11/1879 429/405 |
| 2011/0091059 | A1* | 4/2011 | Sacha ..... H04R 25/50 381/321 |
| 2011/0286615 | A1 | 11/2011 | Olodort et al. |
| 2014/0122116 | A1 | 5/2014 | Smythe |
| 2014/0222462 | A1 | 8/2014 | Shakil et al. |
| 2014/0270227 | A1 | 9/2014 | Swanson |

FOREIGN PATENT DOCUMENTS

| | | |
|---|---|---|
| GB | 2074817 | 4/1981 |
| JP | 06292195 | 10/1998 |
| WO | 2014043179 A2 | 3/2014 |
| WO | 2015110577 A1 | 7/2015 |
| WO | 2015110587 A1 | 7/2015 |

OTHER PUBLICATIONS

BRAGI Is On Facebook (2014).
BRAGI Update—Arrival Of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready To Rumble, A Lot To Be Done Over Christmas (Dec. 22, 2014).
BRAGI Update—Memories From April—Update On Progress (Sep. 16, 2014).
BRAGI Update—Memories from May—Update On Progress—Sweet (Oct. 13, 2014).
BRAGI Update—Memories From One Month Before Kickstarter—Update on Progress (Jul. 10, 2014).
BRAGI Update—Memories From The First Month of Kickstarter—Update on Progress (Aug. 1, 2014).
BRAGI Update—Memories From The Second Month of Kickstarter—Update On Progress (Aug. 22, 2014).
BRAGI Update—New People @BRAGI—Prototypes (Jun. 26, 2014).
BRAGI Update—Office Tour, Tour To China, Tour to CES (Dec. 11, 2014).
BRAGI Update—Status on Wireless, Bits and Pieces, Testing-Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back To China, Backer Day, On Track(May 6, 2015).
BRAGI Update—Beta2 Production and Factory Line(Aug. 20, 2015).

(56) References Cited

OTHER PUBLICATIONS

BRAGI Update—Certifications, Production, Ramping Up.
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2014).
BRAGI Update—On Track, Design Verification, How It Works and What's Next(Jul. 15, 2015).
BRAGI Update—On Track, On Track and Gems Overview.
BRAGI Update—Status On Wireless, Supply, Timeline and Open House@BRAGI(Apr. 1, 2015).
BRAGI Update—Unpacking Video, Reviews On Audio Perform and Boy Are We Getting Close(Sep. 10, 2015).
Healthcare Risk Management Review, "Nuance updates computer-assisted physician documentation solution" (Oct. 20, 2016).
Hoyt et. al., "Lessons Learned from Implementation of Voice Recognition for Documentation in the Military Electronic Health Record System", The American Health Information Management Association (2017).
Last Push Before the Kickstarter Campaign Ends on Monday 4pm CET (Mar. 28, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for The Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).

* cited by examiner

MULTILAYER APPROACH TO HYDROPHOBIC AND OLEOPHOBIC SYSTEM AND METHOD

PRIORITY STATEMENT

This application claims priority to U.S. Provisional Patent Application 62/286,700, filed on Jan. 25, 2016, and entitled Multilayer Approach to Hydrophobic and Oleophobic System and Method, hereby incorporated by reference in its entirety.

BACKGROUND

I. Field of the Disclosure

The illustrative embodiments relate to wearable devices. More particularly, but not exclusively, the illustrative embodiments relate to earpieces.

II. Description of the Art

The growth of wearable devices is increasing exponentially. This growth is fostered by the decreasing size of microprocessors, circuity boards, chips, and other components. The ear and ear canal provide a potentially rich environment for the collection of biometric data through the use of wearable devices and, particularly, earpieces. This is, in part, because the external ear canal sits in close proximity to the central nervous system moving anteromedially until its termination at the tympanic membrane. While the ear canal represents an advantageous environment for the collection of biometric data, the microenvironment of the external auditory ear canal poses certain challenges to devices that occupy some or all of its luminal area. Chief among these issues is the biologic production of cerumen. Cerumen is a mixture of viscous secretions from the sebaceous glands as well as less viscous components from the apocrine sweat glands, desquamated epithelial cells, with a component of saturated and unsaturated long-chain fatty acids, alcohols, squalene and cholesterol. This poses a significant risk to the delicate electronics packages contained in electronic devices purposed to exist at or near the external auditory canal. Further damage to delicate electronic circuitry is elevated to the possibility of sweat exposure, with its mixture of water, sodium and other components. What is needed is an approach to protect delicate electronics packages in such potentially harsh environmental conditions.

SUMMARY OF THE DISCLOSURE

Therefore, it is a primary object, feature, or advantage to improve over the state of the art.

It is a further object, feature, or advantage to protect delicate electronics packages associated with an earpiece from potentially harsh environmental conditions.

It is a still further object, feature, or advantage is to protect earpieces from cerumen.

Yet another object, feature, or advantage is to protect earpieces from sweat exposure.

One or more of these and/or other objects, features, or advantages will become apparent from the specification and claims that follow. No single embodiment need provide each or every one of these objects, features, or advantages. Instead, different embodiments may have different objects, features, or advantages. The present invention is not to be limited by or to these objects, features, and advantages.

According to one aspect a wearable device includes a wearable device housing, an electronics package associated with the wearable device housing, a first barrier overlaying, a first portion of the electronics package, and a second barrier overlaying a second portion of the electronics package. The first barrier may be a hydrophobic barrier and the second barrier may be an oleophobic barrier. The first barrier may be applied directly to the electronics package. The second barrier may be located distal to the electronics package. Either barrier may include a mesh or screen. Either barrier may comprise a nano-coating.

According to another aspect, a method for protecting wearable devices is provided. The method may include utilizing a first hydrophobic barrier and utilizing a second oleophobic barrier. The method may further include utilizing a first hydrophobic barrier that is applied directly to an electronics package. The method may further include utilizing a second oleophobic barrier that is located distal to the first hydrophobic barrier.

According to another aspect, an earpiece may include an earpiece housing, an electronics package associated with the earpiece housing, a hydrophobic barrier on the earpiece, and an oleophobic barrier on the earpiece. The hydrophobic barrier may be applied directly to the electronics package. The oleophobic barrier may be distal to the electronics package. The oleophobic barrier may be an oleophobic nano-coating applied to a mesh or screen. The hydrophobic barrier may be distal to the electronics package. The oleophobic barrier may be distal to the hydrophobic barrier. The hydrophobic barrier may be a nano-coating applied directly to a mesh or screen. The oleophobic barrier may be a nano-coating applied directly to a mesh or screen.

According to another aspect, an ear piece includes an ear piece housing configured for insertion into an ear of a user, an electronics package associated with the ear piece housing, a hydrophobic barrier positioned to protect an electronics package disposed within the ear piece housing, and an oleophobic barrier positioned to protect the electronics package disposed within the ear piece housing. The oleophobic barrier may be located distal to the electronics package. The oleophobic barrier comprises a mesh or screen. The hydrophobic barrier may include a hydrophobic nano-coating. The oleophobic barrier may be an oleophobic nano-coating. The oleophobic barrier may be located distal to the hydrophobic barrier, closer to the tip of the ear piece. The hydrophobic barrier may include a mesh or screen. The wearable device may further include a sleeve for fitting over a tip of the ear piece with the oleophobic barrier is attached to the sleeve. The oleophobic barrier may include a mesh or screen. There may be an oleophobic coating on the mesh or screen of the oleophobic barrier. The hydrophobic barrier may include a hydrophobic coating.

According to another aspect, an ear piece may include an ear piece housing configured for insertion into an ear of a user, an electronics package associated with the ear piece housing, a hydrophobic barrier positioned to protect an electronics package disposed within the ear piece housing, the hydrophobic barrier comprising a hydrophobic coating, and an oleophobic barrier positioned to protect the electronics package disposed within the ear piece housing, the oleophobic barrier comprising qua oleophobic coating. The hydrophobic coating may be a hydrophobic nano-coating. The oleophobic coating may be an oleophobic nano-coating. The hydrophobic barrier may include a mesh or screen with the hydrophobic coating on the mesh or screen. The oleophobic barrier may include a mesh or screen with the oleophobic coating on the mesh or screen.

BRIEF DESCRIPTION OF THE DRAWINGS

Illustrated embodiments of the present invention are described in detail below with reference to the attached drawing figures, which are incorporated by reference herein, and where.

DETAILED DESCRIPTION OF THE DISCLOSURE

Figure 1:
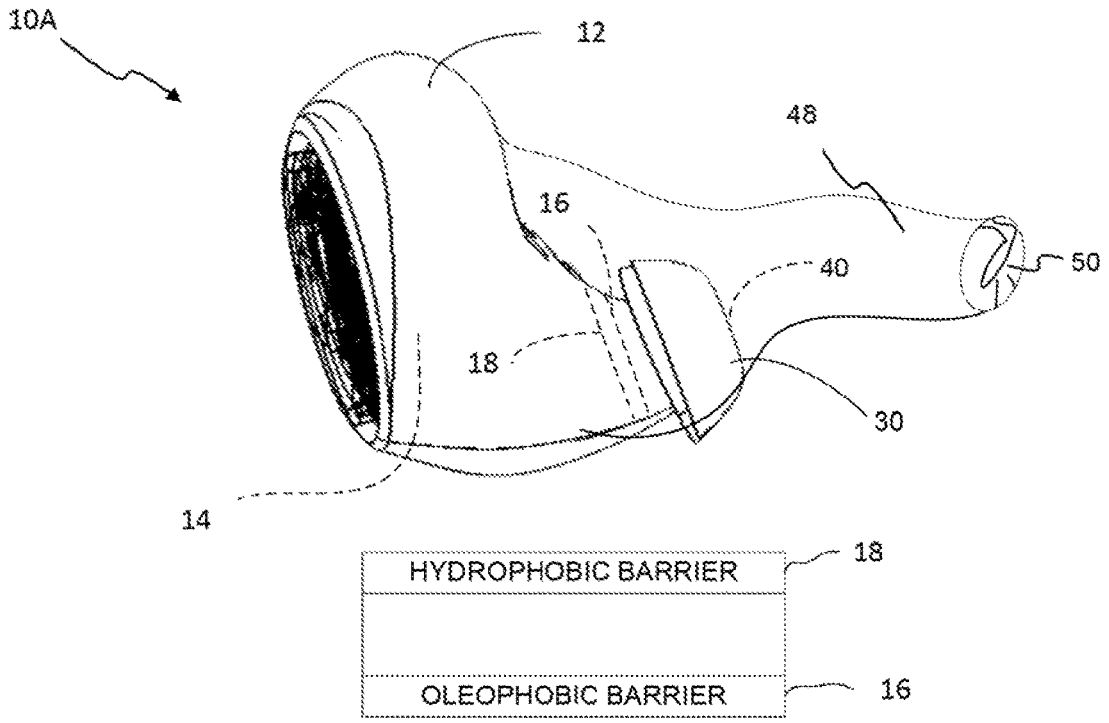
FIG. 1 illustrates one example of an ear piece with a hydrophobic barrier and an oleophobic barrier.

The illustrative embodiments provide a system and method for repelling both hydrophilic and oleophilic compounds in close proximity to the electronics package of wearable devices. The electronics package of wearable devices may contain sensors including temperature sensors, pulse oximeters, accelerometers, gyroscopes, altitude sensors, GPS chips, and so forth. The sensors may be utilized to sense any number of biometric readings or information, such as heart rate, respiratory rate, blood, or skin physiology, or other biometric data. Often, advantageous locations for the placement of such sensors and wearable devices are locations that are also rich in the production or presence of certain biologic compounds.

One location that is used for the collection of biological information is the ear and the auditory canal. The external auditory canal sits in close proximity to the central nervous system, making it a good location for the placement of sensors and collection of biologic data. However, the biological microenvironment of the external auditory canal poses certain challenges to those devices that occupy some, or all, of its luminal area. Among these challenges is the biologic production of cerumen. Cerumen, also known as earwax, protects the inner ear canal and assists with cleaning and lubrication. Cerumen is composed of a mixture of viscous secretions from the sebaceous glands as well as less viscous components from the apocrine sweat glands, desquamated or shed skin cells, and contains components of saturated and unsaturated long-chain fatty acids, alcohols, squalene, and cholesterol.

In addition to cerumen, the presence of sweat and perspiration in areas often closely associated with wearable devices, such as the ear, may pose a significant risk to the function and lifespan of such electronic devices. Sweat contains mostly water, but may also include biologic compounds such as minerals, lactate, and urea. Both the presence of water and additional compounds pose a significant risk to the delicate electronics often found in wearable devices, especially electronics designed to measure biologic functions.

These compounds pose a significant risk to the delicate electronics packages contained in electronic devices purposed to exist at or near the auditory canal. The accuracy and lifespan of these sensors may be altered by the presence of such biologic compounds including, for example, hydrophilic and oleophilic compounds such as those found in cerumen. There is a need for a multi-layer approach to the protection of electronic packages exposed to such potentially harsh environmental conditions. Described herein is a multi-layered approach to the protection of such electronic packages in these harsh environments.

In one embodiment, a two layered approach is utilized to repel both hydrophilic and oleophilic compounds in close proximity to the electronics package. As described herein, one layer would be utilized to repel hydrophilic compounds that might come into close proximity to the electronic package. This may be accomplished, for example, by applying a nano-coating to the electronics package and the sub-components that would function as a hydrophobic barrier. Such hydrophobic coatings or nano-coatings may be made from a variety of materials including, but not limited to, manganese oxide polystyrene, zinc oxide polystyrene, and precipitated calcium carbonate. In addition, easy to apply silica-based nano-coatings may be applied through dipping in a gel or via aerosol spray. In one embodiment, this hydrophilic nano-coating layer may be applied directly to the electronics package. In yet another embodiment, the nano-coating and hydrophobic barrier may be applied to a screen or mesh layer that is distal to the electronics package itself and placed at a position between the electronics package and the source of the biologic compounds. The mesh or screen layer may be made from a variety of materials including, for example, graphene or graphene nanomesh.

A second layer may be utilized that is coated in an oleophobic compound. Such oleophobic coatings or nano-coatings may be made from a variety of materials including, but not limited to, fluoropolymer based solids. This second layer, oleophobic barrier may be spatially segregated from the electronics package or the screen acting as the first layer, hydrophobic barrier. In the embodiment wherein the first, hydrophobic barrier is applied directly to the electronics package, the mesh or screen located distal to the electronics package may be coated with the oleophobic coating or nano-coating and would serve as the barrier to the entry of oleophilic compounds.

In yet another embodiment the first, hydrophobic barrier is applied to the mesh or screen located distal to the electronics package, a second, oleophobic barrier may be applied to a second mesh or screen that is located further distal to the first mesh or screen. In this embodiment the hydrophobic barrier may consist of a hydrophobic coating or nano-coating that is applied to the first mesh or screen through a variety of methods. Similarly, the oleophobic barrier may consist of an oleophobic coating or nano-coating that is applied to the first mesh or screen through a variety of methods. The dual use of the hydrophobic nano-coating and oleo-phobic nano-coating advantageously provides multiple layers of protection for the sensitive electronics package. Further, the use of multiple barriers following this placement provides the benefit of allowing the physiologic placement of the specific nano-coating barrier relative to the compounds most likely to be encountered at these anatomic points.

Additionally, the placement of the barriers may be designed to take advantage of fluid dynamics, such as those embodied by the Hagen-Pouseuille equation (Delta P=(8 μLQ)/(πr^4)). Where Delta P, or the change in pressure, is directly proportionate to the L, or length of the tube. Such a placement of the mesh or screen barriers allows for the replacement of the distal, oleophobic barrier in the event that the mesh or screen is compromised or occluded. The placement of the second mesh or screen on a platform or sleeve may provide the advantage of easy replacement.

FIG. 1 is a pictorial representation of an earpiece 10A positioned within the external auditory canal 48 of a user. A tympanic membrane 50 is shown at the end of the external auditory canal of the user. The earpiece 10A has a housing 12. An electronics package 14 is disposed within the housing 12. The electronics package 14 may contain one or more circuit hoards, connectors, and other electronic components such as processors, transceivers, and sensors. The electronics package 14 may be protected from biological substances through inclusion of one or both of a hydrophobic barrier 18 and an oleophobic barrier 16. The barriers 18, 16 may be meshes, screens, and/or coatings. It should be understood that there may be an opening 40 in the tip 30 of the ear piece which allows for sound produced by a speaker of the earpiece 10A to pass into the external auditory canal 48 of the user. The opening 40 may be an access point for biological material to undesirably enter the earpiece 10A and thus one or more barriers 16, 18 may be positioned to avoid undue infiltration of such materials. It should also be understood that electronics packages or components may otherwise be located and thus the barriers described may be otherwise provided. For example, where the electronics packages or components may include sensors which contact the ear in other locations, barriers may, for example, include appropriate coatings directly on the electronics packages or components.

In one embodiment, a hydrophobic barrier 18 is shown is placed distal to the electronics package 14. The oleophobic barrier 16 is placed distal to the hydrophobic barrier 18. Thus, the electronics package 14 is protected by both the hydrophobic barrier 1 and the oleophobic barrier 16.

The earpiece 10A may be used alone or in conjunction with another ear piece. For example, there may be a set of wireless ear pieces with a left ear piece and a right ear piece. The wireless earpieces may be configured to play music or audio, receive and make phone calls or other communications, determine ambient environmental readings (e.g., temperature, altitude, location, speed, heading, etc.), read user biometrics and actions (e.g., heart rate, motion, sleep, blood oxygenation, calories burned, etc.), or perform other functions. The wireless earpieces may include interchangeable parts that may be adapted to fit the needs of the user. For example, sleeves that fit into the ear of the user may be interchangeable to find a suitable shape and configuration. The wireless earpieces may include a number of sensors and input devices including, but not limited to, pulse oximeters, microphones, pulse rate monitors, accelerometers, gyroscopes, light sensors, global positioning sensors, and so forth.

Figure 2:
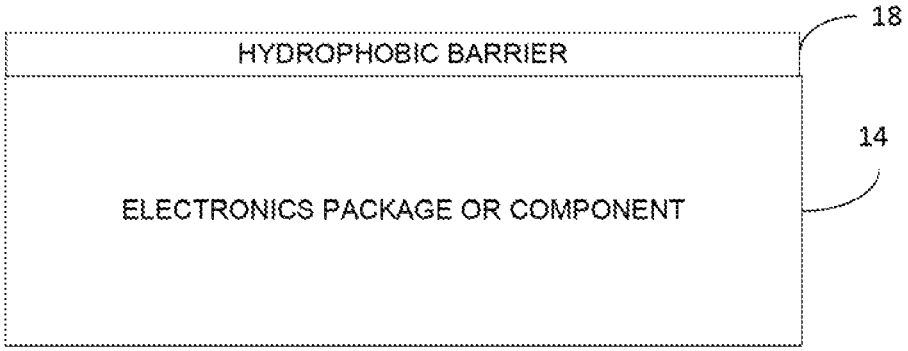
FIG. 2 illustrates one example of an electronics package or component with a hydrophobic barrier.

FIG. 2 illustrates an electronics package or component 14 such as may be disposed within an ear piece housing. As shown in FIG. 2, the electronics package or component 14 is coated with a hydrophobic barrier 14.

Figure 3:
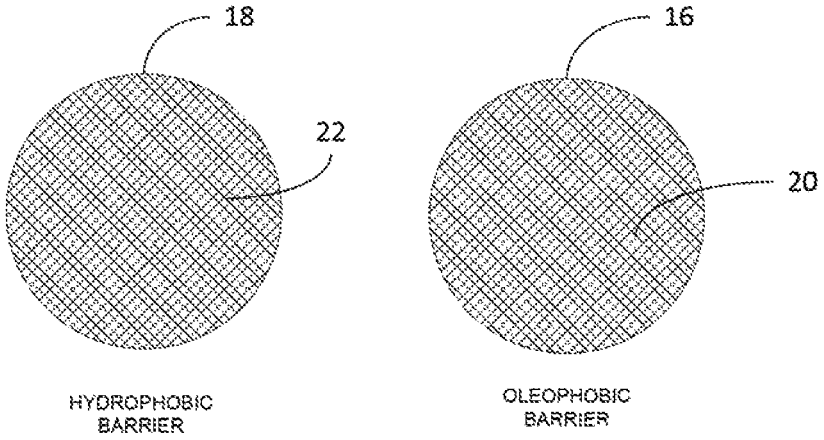
FIG. 3 illustrates an example of hydrophobic barrier in the form of a mesh or screen coated with a hydrophobic coating such as a hydrophobic nano-coating and an oleophobic barrier in the form of a mesh or screen coated with an oleophobic coating such as an oleophobic nano-coating.

FIG. 3 illustrates another example of a hydrophobic barrier 18 and an oleophobic barrier 16. The hydrophobic barrier 18 may be in the form of a mesh or screen with a hydrophobic coating such as a hydrophobic nano-coating. Similarly, the oleophobic barrier 16 may be in the form of a mesh or screen with an oleophobic coating.

Figure 4:
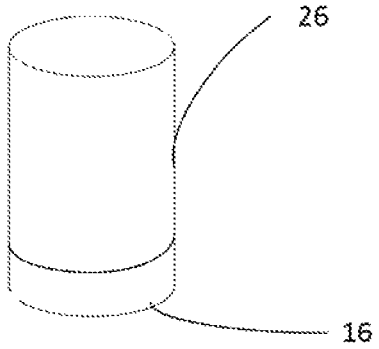
FIG. 4 illustrates an example of a sleeve with an oleophobic barrier attached as a part of the sleeve.
Figure 5:
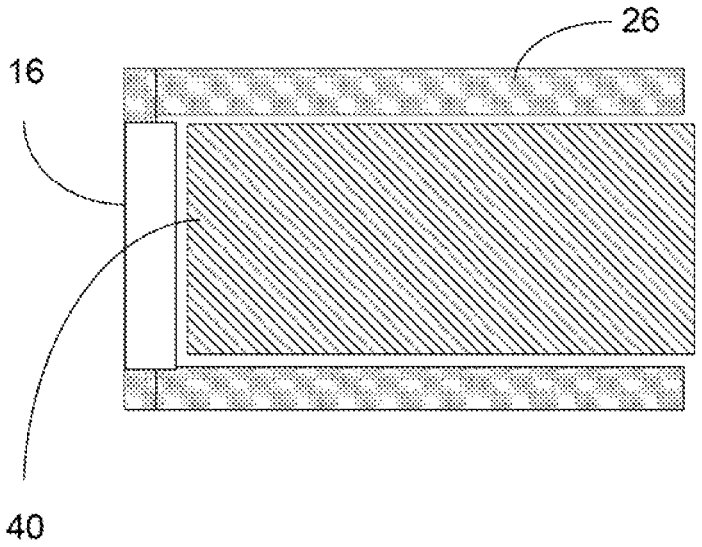
FIG. 5 illustrates another view of a sleeve with an oleophobic barrier in the form of a screen or mesh attached as a part of the sleeve.

FIG. 4 illustrates one example of a platform or sleeve 26. As shown, the sleeve 26 is generally cylindrical with an oleophobic barrier 16 in the form of a mesh or screen on one end of the tube with an opposite open end. In operation, the open end of this sleeve 26 may be fitted over a tip of the ear piece to position the oleophobic barrier 16. One advantage of this configuration is that if the oleophobic barrier 16 is damaged it may be removed and replaced. Another advantage is that the sleeve 26 may be removed for easier cleaning of the oleophobic barrier. It is to be understood that the sleeve 26 may include a hydrophobic barrier instead of the oleophobic barrier or in addition to the oleophobic barrier. FIG. 5 is another view of the sleeve 26 fitted to the tip 40 of the ear piece. An oleophobic barrier 16 is shown.

The illustrative embodiments are not to be limited to the particular embodiments described herein. In particular, the illustrative embodiments contemplate numerous variations in the type of ways in which embodiments may be applied. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of embodiments, processes or methods of the invention. It is understood that any other modifications, substitutions, and/or additions may be made, which are within the intended spirit and scope of the disclosure. For the foregoing, it may be seen that the disclosure accomplishes at least all of the intended objectives.

The previous detailed description is of a small number of embodiments for implementing the invention and is not intended to be limiting in scope. The following claims set forth a number of the embodiments of the invention disclosed with greater particularity.

What is claimed is:

1. An ear piece, the ear piece comprising:

an ear piece housing configured for insertion into an ear of a user;

an electronics package disposed within the ear piece housing;

wherein the electronics package is protected by at least a first and second layer of protective barriers;

the first layer of the protective barrier consisting of a hydrophobic barrier positioned to protect the electronics package disposed within the ear piece housing; and the second layer of the protective barrier consisting of an oleophobic barrier positioned to protect the electronics package disposed within the ear piece housing;

wherein the oleophobic barrier is located distal to the electronics package disposed within the ear piece housing.

2. The ear piece of claim 1, wherein the oleophobic barrier comprises a mesh or screen.

3. The ear piece of claim 1, wherein the hydrophobic barrier comprises a hydrophobic nano-coating.

4. The ear piece of claim 3, wherein the oleophobic barrier is an oleophobic nano-coating.

5. The ear piece of claim 1, wherein the oleophobic barrier is located distal to the hydrophobic barrier.

6. The wearable device of claim 1, wherein the hydrophobic barrier comprises a mesh or screen.

7. The wearable device of claim 1 further comprising a sleeve for fitting over a tip of the ear piece and wherein the oleophobic barrier is attached to the sleeve.

8. The wearable device of claim 7 wherein the oleophobic barrier comprises a mesh or screen.

9. The wearable device of claim 8 further comprising an oleophobic coating on the mesh or screen.

10. The wearable device of claim 9 wherein the hydrophobic barrier comprises a hydrophobic coating.

11. An ear piece, the ear piece comprising:

an ear piece housing configured for insertion into an ear of a user;

an electronics package disposed within the ear piece housing;

wherein the electronics package is protected by at least a first and second layer of protective barriers;

the first layer of the protective barrier comprising a hydrophobic barrier positioned to protect an electronics package disposed within the ear piece housing, the hydrophobic barrier consisting of a hydrophobic coating; and the second layer of the protective barrier comprising an oleophobic barrier positioned to protect the electronics package disposed within the ear piece housing, the oleophobic barrier consisting of an oleophobic coating.

12. The ear piece of claim 11 wherein the hydrophobic coating is a hydrophobic nano-coating.

13. The ear piece of claim 12 wherein the oleophobic coating is an oleophobic nano-coating.

14. The ear piece of claim 11 wherein the hydrophobic barrier further comprises a mesh or screen with the hydrophobic coating on the mesh or screen.

15. The ear piece of claim 14 wherein the oleophobic barrier further comprises a mesh or screen with the oleophobic coating on the mesh or screen.

* * * * *